US006435226B1

(12) United States Patent
Shaw et al.

(10) Patent No.: US 6,435,226 B1
(45) Date of Patent: Aug. 20, 2002

(54) METHOD AND APPARATUS FOR BREACHING AND VENTING SEALED INNER CONTAINERS WITHIN A DRUM

(76) Inventors: Mark D. Shaw, 132 Sea Lily La., Ponte Vedra Beach, FL (US) 32082; J. Tad Heyman, 659 Ocean Blvd., Atlantic Beach, FL (US) 32233; Laurence M. Bierce, 1215 Pine Cir., Macclenny, FL (US) 32063

( * ) Notice: Subject to any disclaimer, the term of this patent is extended or adjusted under 35 U.S.C. 154(b) by 0 days.

(21) Appl. No.: 09/732,693

(22) Filed: Dec. 8, 2000

Related U.S. Application Data

(60) Provisional application No. 60/169,712, filed on Dec. 8, 1999.

(51) Int. Cl.[7] ..... B67B 7/00

(52) U.S. Cl. ..... 141/51; 141/4; 141/8; 141/1

(58) Field of Search ..... 141/1, 4, 8, 51

(56) References Cited

U.S. PATENT DOCUMENTS 5,263,519 A * 11/1993 Reyner ..... 141/20
5,309,956 A * 5/1994 Hajma ..... 141/51
5,465,765 A * 11/1995 Martindale ..... 141/51

* cited by examiner

*Primary Examiner*—J. Casimer Jacyna
(74) *Attorney, Agent, or Firm*—Thomas C. Saitta

(57) ABSTRACT

An apparatus and method for breaching and venting sealed inner containers disposed within a drum, where the drum is evacuated to created a pressure differential resulting in expansion and rupture of the inner containers. The temperature may also be reduced to below freezing in the drum to reduce the elasticity of the inner containers, and the drum may also be pressurized to implode and rupture the inner containers.

45 Claims, 2 Drawing Sheets

METHOD AND APPARATUS FOR BREACHING AND VENTING SEALED INNER CONTAINERS WITHIN A DRUM

This application claims the benefit of U.S. Provisional Patent Application Serial No. 60/169,712, filed Dec. 8, 1999.

BACKGROUND OF THE INVENTION

This invention relates in general to methods and means to breach or puncture sealed containers packed within a sealed storage drum such that gases formed within the sealed inner containers can be safely vented to remove the potential for development of explosive conditions due to the build-up of hydrogen gas within the drum. In particular, the invention relates to any such methods or means where the task is accomplished without requiring opening of the drum for removal and repackaging of the inner containers.

Hazardous wastes such as radioactive or chemical hazardous wastes, or in particular trans-uranic (TRU) wastes comprising radioactive elements, are currently typically disposed of by packing the wastes inside large drums, such as 55 gallon cylindrical plastic or metal drums, which are either closed in an air-tight manner such that no gases or other matter can escape from the containment, or are closed in a vented manner such that some gases are allowed to vent. In either case it is required that no radioactive material or substance can escape from the containment. The drums are then shipped to remote storage facilities for final storage, where they are stored underground or in specially designed structures. In many circumstances radiolysis (chemical decomposition brought about by radiation), chemical reactions or organic decomposition of the material placed within the drums creates hydrogen and/or other undesirable gases, resulting in a build-up over time of excessive amounts of hydrogen and/or other gases within the drum which if not addressed can lead to the formation of potentially explosive conditions. For example, it is potentially dangerous if the percentage of hydrogen gas exceeds five percent of the drum atmosphere. To address this serious problem, it is known to provide the storage drums with selective venting filters or other such devices which allow passage of hydrogen gases while retaining radioactive particulates within the drums. Unfortunately, many times the hazardous waste is first confined within inner layers of confinement, such as heat sealed, tied or knotted plastic bags made of relatively thin, flexible, relatively elastic, polyethylene (PE), polyurethane (PU) or polyvinyl chloride (PVC), cans or other rigid walled containers, or the like, which are then placed within the large drums, and a single drum will often contain multiple bags or other inner containers. Sometimes a quantity of hazardous waste is placed into two or more bags, with the first bag sealed and placed within the second, which is then sealed, etc. This results in an inner containment device with multiple layers of confinement. The drum itself forms the outer or primary layer of confinement and the inner containers form inner or secondary layers of confinement for the hazardous waste. Because the plastic bags and other inner containers are sealed and are by their nature impermeable to the gases which are formed over time, the gases are trapped and cannot pass through any venting devices provided for the drum, and undesirable or dangerous hydrogen gas build-up may occur within the drum.

In addition to the problem set forth above, some drums are provided with rigid internal polyethylene liners. In this case the drum forms the primary layer of confinement and the rigid internal liner forms a secondary containment layer.

Likewise, the drums often contain sealed cans or other rigid wall containers and aerosol cans, and the gases present in these cans are not addressed by the known approaches.

Government transportation regulations promulgated by the Department of Energy, the Nuclear Regulatory Commission and other agencies require that where flexible inner layers of confinement are present within a drum, i.e., individual sealed bags or other containers, the amount of fissile hazardous material or the total waste wattage must be significantly limited in each drum. These regulations significantly increase shipping costs and require that excess amounts of fissile hazardous material or excess total waste wattage in a single drum must be repackaged into multiple drums. The current approach to this task involves opening the drums, physically breaching all the inner containers and then repackaging the containers within the drum or dispersing the containers into multiple drums. The bags cannot be merely punctured or slit, since the openings could be blocked upon repacking, resulting in entrapment of any new gases formed over time. Because of the hazardous nature of the materials involved, this process is extremely expensive due to the need to protect the workers from excessive exposure and due to the need to safely handle and isolate the hazardous materials from the environment during this operation, and costs for this type of operation can exceed $10,000 per drum. The amount of radioactive waste which can be put into a single drum having inner layers of confinement is severely restricted since the drum will have to be opened and processed. For example, 20 grams of plutonium waste may be confined within a single drum under the guidelines where no inner containers are present, but only 2 grams of plutonium waste is allowed if there are inner containers. There are currently an estimated 800,000 drums containing radioactive TRU waste which require venting and subsequent storage. Current regulations preclude transport of the drums unless the drums contain less than five percent hydrogen gas.

It is an object of this invention to provide a means to safely breach the inner containment layers within a larger containment drum at relatively low cost, without requiring the opening of the drum and the handling and repackaging of the inner containers. It is a further object to provide a means and method to perform this task which significantly reduces or removes worker exposure to the hazardous material, which can be performed at remote and various sites, which poses little or no threat for environmental release, which does not damage or degrade the drum, which does not cause chemical reactions within the drum, which functions on either PE, PU or PVC bags, which accounts for the problems created by rigid PE liners and sealed rigid-wall cans, and which breaches the inner containers in such manner that openings formed in the containers will not be blocked so that any gases which are produced over time subsequent to the initial venting and breaching operation will not be trapped by the inner containers but can be removed in routine manner by venting devices.

SUMMARY OF THE INVENTION

In general, the invention is a method and apparatus means for breaching and venting sealed inner containers contained within a larger storage or shipping drum, such as a 55 gallon plastic or metal drum, as well as the drum itself, without requiring the drum to be opened and the inner containers removed, breached and repacked. The total volume of the inner containers is typically 90 percent or less of the total drum volume, such that a void is present in the drum. In particular, the invention is a method and apparatus for breaching and venting inner containers consisting of thin-walled, flexible PE, PU or PVC bags which have been sealed, and which contain hazardous materials such as radioactive or chemical wastes. In a more preferred embodiment, the invention is also a method and apparatus for breaching and venting sealed cans, aerosol cans and the like in addition to the sealed bags.

The invention comprises providing a drum interior access means such as a venting mechanism device or fitting, preferably self-drilling, self-tapping and self-sealing, with a specialized filter to preclude passage of undesirable gases and particulates, which is inserted through the lid of the drum to create a communicating passageway to the interior of the drum, where the venting mechanism has suitable fluid communication passageways for evacuating, pressurizing or freezing the interior of the drum. The venting mechanism is connected to a vacuum pumping apparatus, such that a high vacuum can be pulled through the venting mechanism. The atmosphere within the drum is evacuated, causing the inner containers to expand and burst due to the pressure differential between the interior of the sealed bags and the evacuated interior of the drum. The atmosphere drawn from the drum may be returned to the drum after the inner containment layers have been breached and vented, or it may disposed of separately with ambient atmosphere or another gas supplied into the drum to normalize the internal pressure.

In a preferred embodiment, the invention further comprises providing a liquid nitrogen source and providing fluid communication means, preferably within the venting mechanism itself, to deliver liquid nitrogen into the drum in order to freeze the flexible bags prior to the drum evacuation step. This converts the bag compositional material from a flexible and elastic material to a brittle material, or at least a material of reduced elasticity, and is particularly efficacious when bags made of PVC form some or all of the inner containers. In an alternative embodiment, means to increase the pressure within the drum are provided, such as by the introduction of compressed air, and the method further entails increasing the internal drum pressure prior to evacuating the drum. Alternatively, various combinations of pressurization, evacuation and freezing steps may be utilized, and each step may be performed more than once.

In another preferred embodiment, a sealable secondary chamber is provided to receive and contain the drum during the various processing operations. This allows the pressure external to the drum within the secondary chamber to be controlled, such that the pressure differential between the interior of the drum and the exterior of the drum may be maintained within defined safe tolerances to prevent damage to the drum. The pressure within the secondary chamber may be controlled by a separate evacuation and pressurization means, or the venting mechanism may be provided with auxiliary conduit or valve means such that the pressure within the drum and within the chamber but external to the drum remain within the defined tolerances with the use of single evacuation and pressurization means.

DETAILED DESCRIPTION OF THE INVENTION

Figure 1:
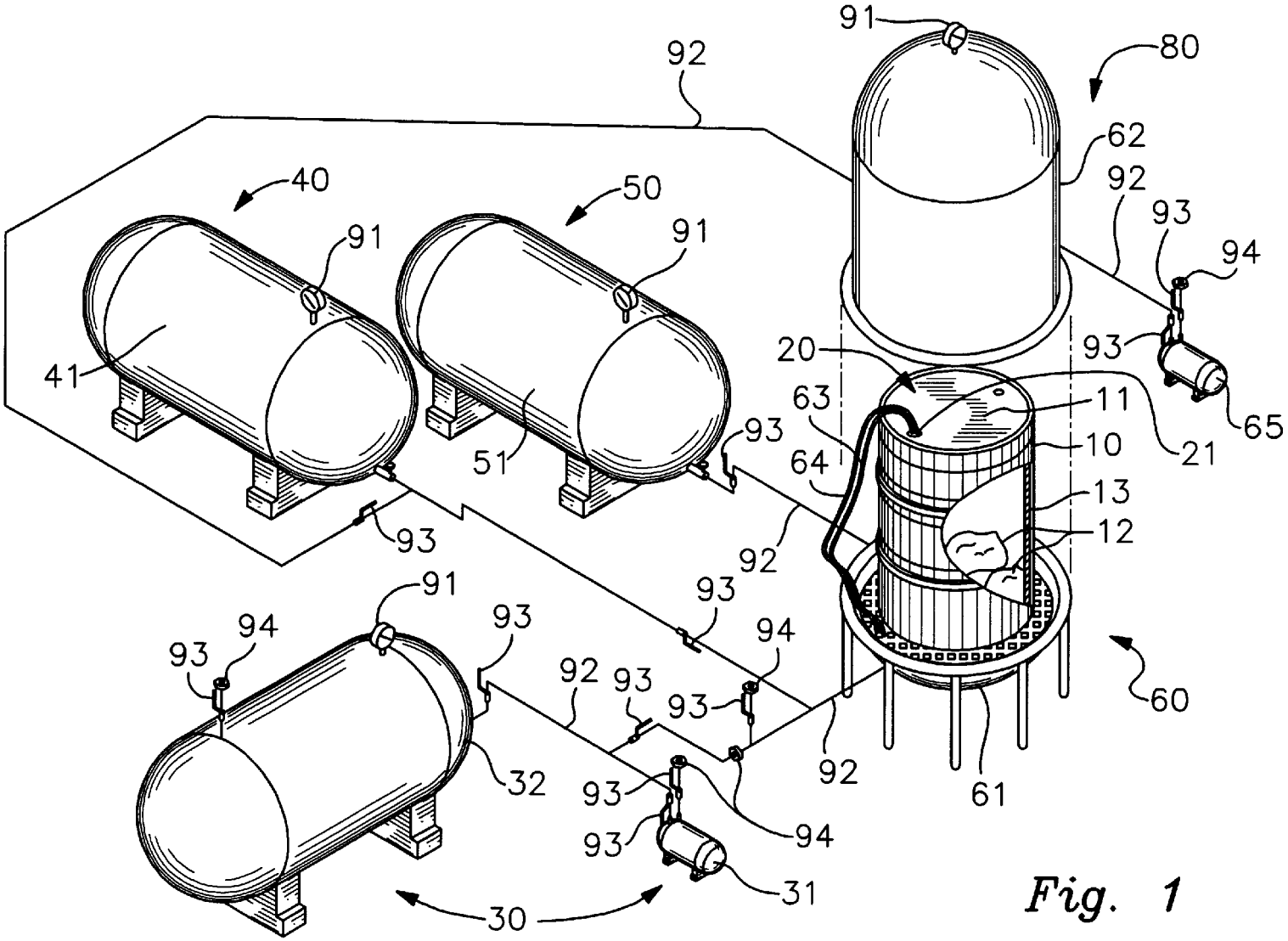
FIG. 1 is an illustration of a preferred embodiment of the invention, showing means to evacuate the drum, means to pressurize the drum, means to freeze the contents of the drum, and secondary containment means to control the atmospheric pressure external to the drum during the evacuation and pressurization operations.

With reference to the drawings, the invention will now be described in detail with regard for the best mode and preferred embodiment. In general, the invention comprises an apparatus or system of connected elements, as shown in FIG. 1, and the method of using this apparatus for breaching and venting interior layers of gas confinement within a primary layer of confinement. The apparatus means comprises in general in a basic embodiment evacuation means 30 for removing fluids, primarily gases, from the interior of a drum 10, which defines the primary layer of confinement, by lowering the pressure therein, thereby causing any internal containers 12 comprising flexible, generally elastic, thin-walled bags, i.e., the internal layers of confinement, to burst due to the expansion resulting from the pressure differential between the gases sealed within interior of the bags and the reduced pressure in the interior of the drum 10 external to the bags. In more preferred embodiments, the apparatus means also comprises pressurization means 40 for increasing the pressure within the drum 10, temperature reduction means 50 for dramatically lowering the internal temperature within the drum 10, and secondary chamber means 60 in conjunction with pressure balancing means 80 to receive the drum 10 during the operations in order to provide an enclosed area of controlled pressure external to the drum 10. Drum interior access means 20, comprising a fluid communications fitting, is disposed on the drum 10 to provide fluid communication passageways to allow gases and liquid nitrogen to pass into and out of the drum 10 in a controlled manner. The method of the invention comprises in a basic embodiment the step of drawing a vacuum on the interior of the drum 10 in order to cause any internal containers 12 comprising flexible, generally elastic, thin-walled bags to burst due to the expansion resulting from the pressure differential between the gases sealed within interior of the bags and the reduced pressure in the interior of the drum 10 external to the bags. In more preferred embodiments, the method further comprises significantly reducing the temperature within the drum 10 to cause the bags to become brittle, thereby enhancing the breaching effect when the drum evacuation step is performed, and/or pressurizing the drum interior by increasing the pressure to cause the bags to breach by implosion or contact with solid objects within the bags. The freezing, evacuating and pressurizing steps may be performed in repeated or varied patterns if desired. In a further preferred embodiment, the pressure differential in the atmosphere external to the drum 10 and in the atmosphere internal to the drum 10 is maintained within predetermined safety tolerances.

Drum 10, the primary layer of confinement, is typically a 55 gallon plastic or metal container of generally cylindrical shape having a removable lid member 11 which creates a gas impermeable seal when properly positioned onto the body of the drum 10. The term drum shall be taken herein to also refer to metal boxes of the type also used in the industry for storage of hazardous wastes. The drum 10 may include a drum-shaped, rigid, inner liner 13, typically formed of polyethylene. Disposed within the drum 10 are one or more inner containers 12 comprising sealed bags made of flexible, generally elastic, thin-walled polyethylene, polyurethane or polyvinyl chloride plastic, which retain hazardous material, such as radioactive or chemical waste. This hazardous waste often produces gases, primarily hydrogen gas, due to radioactive decay, chemical reactions or organic decomposition. The inner containers 12 do not completely occupy the full interior of the drum 10, thereby providing a void which allows for expansion of the inner containers 12 during the evacuation process of the invention. Because the gas build-up occurs within the sealed inner containers 12, standard venting procedures will not remove the gas from the interior of the drum 10 unless the inner containers 12 are breached. If the hydrogen gas percentage within the drum 10 increases unabated, the percentage may exceed the maximum acceptable amount and potentially explosive conditions may result. Thus storage and transportation guidelines set maximum acceptable thresholds for gas build-up within the drums 10. Where the drums 10 contain no interior layers of confinement, the gas is easily removed. Where the drums 10 contain interior layers of confinement, these must be breached so that the drum 10 can be sufficiently vented to avoid repackaging costs.

In order to vent a drum 10, drum interior access means 20 is provided, and typically consists of a filter vent fitting 21 disposed in the lid 11 of the drum 10. The drum interior access means 20 provides fluid communication passageways between the interior and the exterior of the drum 10 through which gases may pass, and extends through the rigid inner liner 13 if present, with the filter component preventing passage of radioactive particulates through the fitting 21 while allowing passage of the hydrogen or other desirable gases or substances. In this invention, the drum interior access means 20 allows gases to be drawn from the interior of the drum 10, and preferably also allows pressurization gases and liquid nitrogen or other cryogenic substances to be directed into the interior of the drum 10.

Evacuation means 30 to create a vacuum for lowering the pressure within the drum 10 is provided, and comprises in basic form a vacuum or evacuation pumping means 31 connected by fluid communication conduit means 92 to the drum interior access means 20. Evacuation means 30 may further comprise a storage tank 32 into which the gases evacuated from the interior of the drum 10 are deposited. In standard format, valves 93, a tank pressure gauge 91 and filter/venting mechanisms 94 to control the evacuation operation further comprise the evacuation means 30. The evacuation means 30 must be capable of pulling a high vacuum, preferably about 28 inches of mercury or more, at a high flow rate, preferably 3 cfm or greater. The high evacuation rate insures that the inner containers 12 burst in catastrophic manner rather than slowly bleeding out the internal gases through small apertures.

In a more preferred embodiment, the invention further comprises temperature reduction means 50, which comprises a cryogenic system capable of producing extremely low temperatures within the interior of the drum 10. As shown, temperature reduction means 50 comprises a storage tank 51 containing a cryogenic substance, such as liquid nitrogen, which is connected in fluid communicating manner by conduits 92 to the drum interior access means 20, such that the liquid nitrogen can be introduced into the interior of the drum 10 in order to freeze the inner containers 12. In standard format, valves 93 to control the cryogenic operation may further comprise the temperature reduction means 50.

In an alternative embodiment, the invention further comprises pressurization means 40, which is a system capable of greatly increasing the pressure within the interior of the drum 10. Pressurization means 40 as shown comprises a compressed air storage tank 41 which is connected in fluid communicating manner by conduits 92 to the interior of drum 10,such that the compressed air can be introduced into the interior of the drum 10 to increase the pressure. Alternatively, the interior pressure can be increased utilizing the expansion of the cryogenic substance, e.g., liquid nitrogen, introduced in the temperature reduction step. In standard format, valves 93 to control the pressurization operation may further comprise the pressurization means 50.

Figure 2:
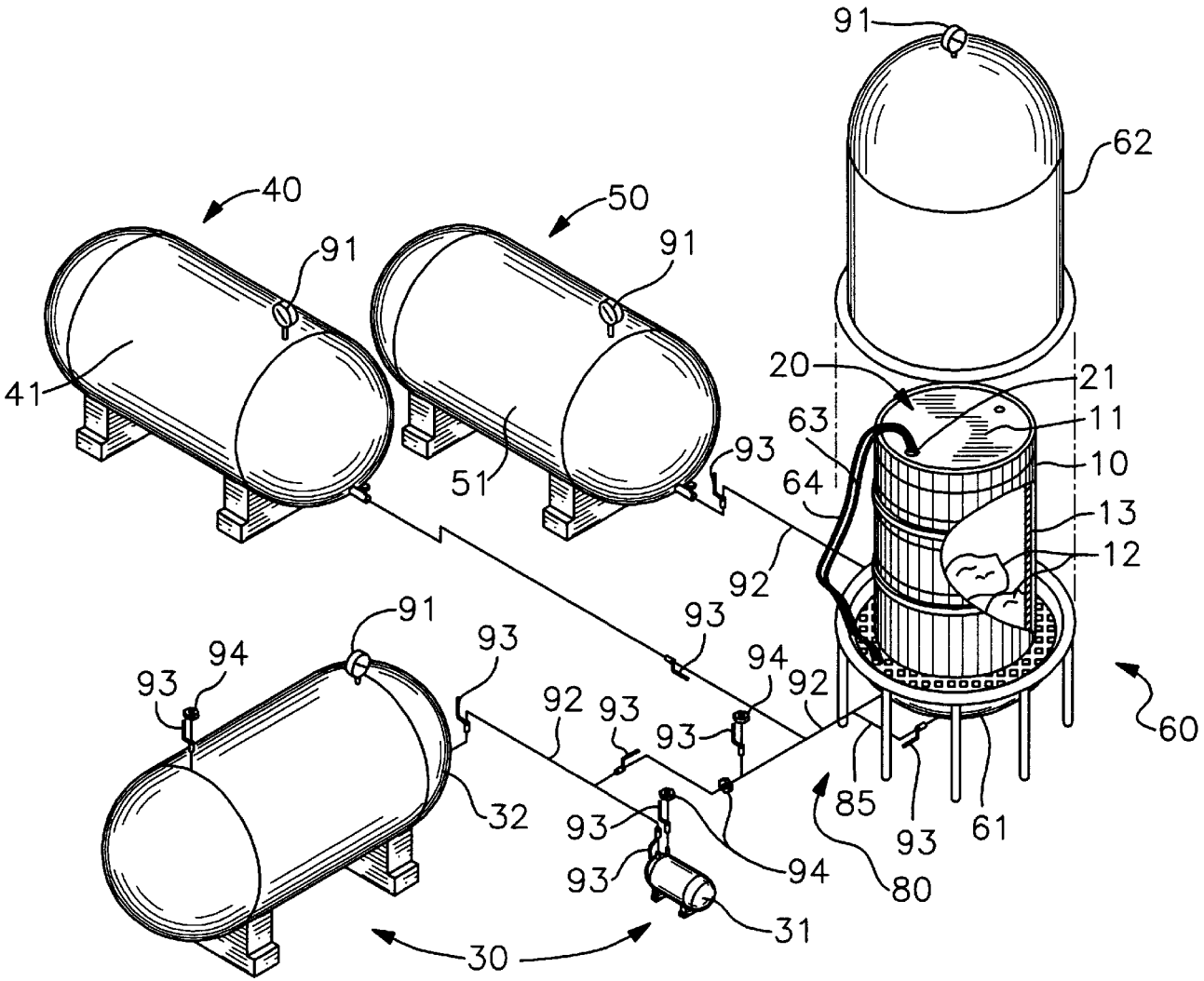
FIG. 2 is an illustration similar to FIG. 1, where the pressure balancing means is incorporated into the evacuation and pressurization means.

In a more preferred embodiment, the invention further comprises secondary chamber means 60 which is structured and sized to receive and enclose in a sealed manner a drum 10. Secondary chamber means 60 as shown comprises a base member 61 which receives and supports a drum 10, and a cover member 62 which mates with the base member 61 to define a sealed area around drum 10. In this embodiment, the conduits 92 from the evacuation means 30, pressurization means 40 and temperature reduction means 50 connect to flexible conduits disposed within the interior of the secondary chamber means 60, which as shown comprise a chamber vacuum/pressure conduit 63 and a chamber cryogenic conduit 64, which are both connected to the drum interior access means 20. The secondary chamber means 60 allows for control of the pressure in the area within the secondary chamber external to the drum 10 to prevent catastrophic failure, such that the pressure differential between the interior of the drum 10 and the exterior of the drum 10 may be maintained within a predetermined maximum pressure differential value to preclude accidental implosion of the drum 10 when its interior is evacuated or explosion of the drum 10 when its interior is pressurized by pressure balancing means 80. In one embodiment for the pressure balancing means 80, as shown in FIG. 1, the secondary chamber means 60 may be provided with a chamber evacuation pumping means 65 in fluid communication with the interior of the secondary chamber means 60 in order to reduce pressure external to the drum 10 within the secondary chamber means 60 when the drum 10 is being evacuated. To increase pressure external to the drum 10 within the secondary chamber means 60 when the drum is being pressurized, the secondary chamber means 60 may be connected by conduit 92 to the pressurization means 40. In an alternative embodiment for the pressure balancing means 80, as shown in FIG. 2, provision may be made in the evacuation means 30 and pressurization means 40 to simultaneously control the internal pressure within the drum 10 and the external pressure within the secondary chamber means 60. This may be accomplished by providing balancing conduits 85 which communicate with the interior of the secondary chamber means 60.

In a basic embodiment, the method of the invention comprises the steps of providing evacuation means 30 in fluid communication with the interior of the drum 10 containing sealed inner containers 12, and evacuating the interior of the drum such that the pressure differential between the interior of the drum 10 and the interiors of the inner containers 12 is so great that the inner containers 12 rapidly expand into the void and rupture, thereby permanently breaching the inner containers 12 and removing the gases initially trapped within the inner containers 12. As each inner container 12 ruptures, the area available for expansion increases such that the remaining inner containers 12 are more susceptible to rupture. The filter component of the drum interior access means 20 prevents the evacuation of harmful gases or particulates from the drum 10. Pressure within the drum 10 is then allowed to return to normal atmospheric pressure. If no drum interior access means 20 is disposed on the drum 10 as presented, then a drum interior access means 20 is positioned on the drum lid 11, with the drum interior access means 20 producing a conduit through the lid 11 and the rigid inner liner 13 if present.

It has been found that this basic technique of only evacuation is suitably efficient with regard to inner containers 12 consisting of thin-walled polyethylene bags, but the method does not work as well with bags made of polyvinyl chloride or thicker bags. Thus a more preferred method comprises the further steps of providing temperature reduction means 50 in fluid communication with the interior of the drum 10, and reducing the temperature within the drum 10 to at least 0 degrees F., and preferably much lower, to dramatically reduce the elasticity of the PE, PU or PVC bags comprising the inner containers 12. This cryogenic step is preferably performed prior to the evacuation step, such that the inner containers 12 are much more susceptible to rupturing when the interior of the drum 10 is evacuated. For example, the temperature reduction may be accomplished by slowly introducing approximately 1 to 1.5 liters of liquid nitrogen into the drum 10, which reduces the internal temperature to approximately −200 degrees C. This not only serves the function of severely reducing the elasticity of the inner containers, it produces a high nitrogen-content atmosphere in the drum 10, thereby reducing the possibility of oxidation reactions occurring as the inner containers 12 are breached. The nitrogen is introduced slowly, preferably at a rate such that the interior pressure of the drum is not increased more than 5 psi. Outgassing will occur through the drum interior access means 20 to further limit excess pressurization. The reduction in temperature also causes some PVC inner containers 12 to implode due to the contraction of the air sealed within the inner containers 12, the brittle state of the bag material results in shattering rather than simple holes or slits being formed. It has also been discovered that the temperature reduction step also increases the likelihood of breaching metal cans, aerosol cans and other rigid wall inner containers 12 when the evacuation step is performed.

In an alternative embodiment, the method further comprises the steps of providing pressurization means 40 in fluid communication with interior of the drum 10, and increasing the pressure within the drum 10 to cause the inner containers 12 to implode. This step is preferably performed after the temperature reduction step, with the evacuation step being performed subsequently thereto. Alternatively, the pressurization step may be accomplished using the cryogenic substance, e.g., liquid nitrogen, introduced in the temperature reduction step.

The combination of evacuation and temperature reduction steps, the combination of evacuation and pressurization steps, or the combination of evacuation, temperature reduction and pressurization steps may be repeated on a single drum as required, and the order of multiple steps may be varied. For example, it may be desirable to evacuate the drum 10 prior to reducing the internal temperature, as the evacuation step removes water vapor present in the drum 10 and may prevent clogging of the drum interior access means 20 by ice formation when the cryogenic substance is introduced therethrough.

It is most preferred that the method further comprise the steps of providing a secondary chamber means 60 adapted to receive the drum 10, where the secondary chamber means 60 defines an area external to the drum 10 within which the pressure may be controlled, and controlling the pressure within the secondary chamber means 60 external to the drum 10 by pressure balancing means 80 such that the pressure external to the drum 10 is maintained relatively equal, or at least within a predetermined acceptable maximum pressure differential value, of the pressure internal to the drum 10. For example, it is preferred that the pressure differential between the drum interior and the drum exterior within the secondary chamber means 60 be kept within approximately 5 psi to preclude failure of the drum 10. Thus, during evacuation of the drum 10 the secondary chamber means 60 is also evacuated, and during pressurization of the drum 10 the secondary chamber means 60 is also pressurized. Evacuation of the secondary chamber means 60 may be accomplished by using the evacuation pumping means 31 or by providing a secondary chamber pumping means 65. Pressurization of the secondary chamber means 60 may be accomplished by using the pressurization means 40, the temperature reduction means 50, by introducing for example liquid nitrogen, or by providing alternative pressurizing equipment.

It is contemplated that equivalents and substitutions for certain elements or steps described above may be obvious to those skilled in the art, and the true scope and definition of the invention therefore is to be as set forth in the following claims.

We claim:

1. A method for breaching and venting sealed inner containers disposed within a drum, the method comprising the steps of:

providing drum interior access means which creates a fluid communication passageway into the interior of a drum containing sealed inner containers;

providing evacuation means to reduce the pressure within said drum by evacuating gases, whereby said evacuation means is in fluid communication with said drum interior access means;

evacuating said drum whereby expansion of said inner containers caused by the pressure differential results in rupture and venting of said inner containers;

providing temperature reduction means to reduce the temperature within said drum to at least 0 degrees F., whereby said temperature reduction means is in fluid communication with said drum interior access means; and reducing the temperature within said drum whereby the elasticity of said inner containers is reduced.

2. The method of claim 4, wherein said evacuation means comprises a pumping means and conduits connecting said pumping means to said drum interior access means, whereby said evacuating means is performed by said pumping means.

3. The method of claim 2, wherein said evacuation means further comprises a storage and conduits connecting said storage tank to said pumping means, whereby said pumping means delivers said gases from said drum to said storage tank.

4. The method of claim 1, wherein said temperature reduction step is performed prior to said evacuation step.

5. The method of claim 1, wherein said temperature reduction step is performed by introducing liquid nitrogen into said drum.

6. The method of claim 5, wherein said temperature reduction means comprises a storage tank containing liquid nitrogen and conduits connecting said storage tank to said drum interior access means, whereby said liquid nitrogen is delivered from said liquid nitrogen storage tank into said drum.

7. The method of claim 1, wherein said drum interior access means comprises a filter vent fitting disposed onto said drum, wherein said filter vent fitting allows passage of hydrogen gases but prevents passage of radioactive particulates, wherein said evacuation step comprises evacuating said hydrogen gases.

8. The method of claim 1, further comprising the steps of:

providing pressurization means to increase the pressure within said drum by introducing gases whereby said pressurization means is in fluid communication with said drum interior access means; and increasing the pressure within said drum whereby contraction of said sealed containers caused by the pressure differential results in rupture of said inner containers.

9. The method of claim 8, wherein said pressurization step is performed prior to said evacuation step.

10. The method of claim 8, wherein said pressurization step is performed by introducing compressed air into said drum.

11. The method of claim 10, wherein said pressurization means comprises a compressed air storage tank and conduits connecting said compressed air storage tank to said drum interior access means, whereby compressed air is delivered from said compressed air storage tank into said drum.

12. The method of claim 8, further comprising the steps of:

providing secondary chamber means to enclose said drum to define a sealed area exterior to said drum;

providing pressure balancing means to control the pressure exterior to said drum within said secondary chamber means; and controlling the pressure exterior to said drum within said secondary chamber means.

13. The method of claim 12, further comprising the steps of:

determining an acceptable maximum pressure differential value for said exterior area within said secondary chamber means relative to said interior of said drum; and maintaining the pressure differential between said exterior area within said secondary chamber means and said interior of said drum such that said pressure differential does not exceed said acceptable maximum pressure differential value during said evacuation and said pressurization steps.

14. The method of claim 8, wherein said pressurization step is performed by introducing liquid nitrogen into said drum.

15. The method of claim 1, further comprising the steps of:

providing secondary chamber means to enclose said drum to define a sealed area exterior to said drum;

providing pressure balancing means to control the pressure exterior to said drum within said secondary chamber means; and controlling the pressure exterior to said drum within said secondary chamber means.

16. The method of claim 15, further comprising the steps of:

determining an acceptable pressure differential value for said exterior area within said secondary chamber means relative to said interior of said drum; and maintaining said pressure differential value during said evacuation step.

17. The method of claim 16, wherein said pressure balancing means comprises said evacuating means pumping means, whereby said pressure exterior to said drum within said secondary chamber means is maintained by simultaneously evacuating said secondary chamber means and said drum.

18. The method of claim 16, further comprising the steps of:

providing secondary chamber evacuation means distinct from said drum evacuating means; and evacuating said secondary chamber means simultaneously with said drum evacuation step.

19. The method of claim 15, further comprising the steps of:

determining an acceptable maximum pressure differential value for said exterior area within said secondary chamber means relative to said interior of said drum; and maintaining the pressure differential between said exterior area within said secondary chamber means and said interior of said drum such that said pressure differential does not exceed said acceptable maximum pressure differential value during said evacuation step.

20. An apparatus for breaching and venting sealed inner containers disposed within a drum, said drum comprising an interior and a lid, said apparatus comprising:

drum interior access means disposed onto said drum and creating a fluid communication passageway into the interior of said drum, said drum interior access means comprising a filter vent fitting which allows passage of hydrogen gas while preventing passage of radioactive particulates; and evacuation means to reduce the pressure within said drum by evacuating gases in sufficient amount to rupture and vent said inner containers, said evacuation means in fluid communication with said drum interior access means.

21. The apparatus of claim 20, wherein said evacuation means comprises a pumping means and conduits connecting said pumping means to said drum interior access means.

22.The apparatus of claim 21, wherein said evacuation means further comprises a storage tank and conduits connecting said storage tank to said pumping means.

23. The apparatus of claim 20, further comprising:

temperature reduction means to reduce the temperature within said drum to at least 0 degrees F., said temperature reduction means in fluid communication with said drum interior access means.

24. The apparatus of claim 23, wherein said temperature reduction means comprises a source of liquid nitrogen and conduits connecting said liquid nitrogen source to said drum interior access means.

25. The apparatus of claim 24, wherein said temperature reduction means further comprises a liquid nitrogen storage tank.

26. The apparatus of claim 23, further comprising:

pressurization means to increase the pressure within said drum by introducing gases, said pressurization means in fluid communication with said drum interior access means.

27. The apparatus of claim 26, wherein said pressurization means comprises a source of compressed air and conduits connecting said compressed air source to said drum interior access means.

28. The apparatus of claim 27, wherein said pressurization means further comprises a compressed air storage tank.

29. The apparatus of claim 26, further comprising:

secondary chamber means receiving said drum and defining a sealed area exterior to said drum; and pressure balancing means to control the pressure within said secondary chamber means exterior to said drum.

30. The apparatus of claim 29, wherein said pressure balancing means comprises a secondary chamber pumping means.

31. The apparatus of claim 29, wherein said secondary chamber means comprises a base member and a cover member.

32. The apparatus of claim 26, wherein said pressurization means comprises a source of liquid nitrogen and conduits connecting said liquid nitrogen source to said drum interior access means.

33. The apparatus of claim 23, further comprising:

secondary chamber means receiving said drum and defining a sealed area exterior to said drum; and pressure balancing means to control the pressure within said secondary chamber means exterior to said drum.

34. The apparatus of claim 33, wherein said pressure balancing means comprises a secondary chamber pumping means.

35. The apparatus of claim 33, wherein said secondary chamber means comprises a base member and a cover member.

36. The apparatus of claim 20, further comprising:

pressurization means to increase the pressure within said drum by introducing gases, said pressurization means in fluid communication with said drum interior access means.

37. The apparatus of claim 36, wherein said pressurization means comprises a source of compressed air and conduits connecting said compressed air source to said drum interior access means.

38. The apparatus of claim 37, wherein said pressurization means further comprises a compressed air storage tank.

39. The apparatus of claim 36, further comprising:

secondary chamber means receiving said drum and defining a sealed area exterior to said drum; and pressure balancing means to control the pressure within said secondary chamber means exterior to said drum.

40. The apparatus of claim 39, wherein said pressure balancing means comprises a secondary chamber pumping means.

41. The apparatus of claim 39, wherein said secondary chamber means comprises a base member and a cover member.

42. The apparatus of claim 36, wherein said pressurization means comprises a source of liquid nitrogen and conduits connecting said liquid nitrogen source to said drum interior access means.

43. The apparatus of claim 20, further comprising:

secondary chamber means receiving said drum and defining a sealed area exterior to said drum; and pressure balancing means to control the pressure within said secondary chamber means exterior to said drum.

44. The apparatus of claim 43, wherein said pressure balancing means comprises a secondary chamber pumping means.

45. The apparatus of claim 43, wherein said secondary chamber means comprises a base member and a cover member.

* * * * *